United States Patent [19]

Carter

[11] 4,426,909

[45] Jan. 24, 1984

[54] NOISE, FLASH AND SMOKE SUPPRESSOR APPARATUS AND METHOD FOR ROCKET LAUNCHER

[75] Inventor: Charles R. Carter, Huntsville, Ala.

[73] Assignee: The Boeing Company, Seattle, Wash.

[21] Appl. No.: 313,227

[22] Filed: Oct. 20, 1981

[51] Int. Cl.[3] ..... F41F 3/04; F41F 17/12

[52] U.S. Cl. ..... 89/1.816; 89/14 D

[58] Field of Search ..... 89/1.809, 1.816, 1.8, 89/1.7, 1.703, 1.704, 1.706, 140, 1.705

[56] References Cited

U.S. PATENT DOCUMENTS

| | | | |
|---|---|---|---|
| 227,341 | 5/1880 | Zellner | 89/14 D |
| 2,043,731 | 6/1936 | Bourne | 89/14 D |
| 2,625,235 | 1/1953 | Caulkins | 89/14 D |
| 3,255,668 | 6/1966 | Vilbajo | 89/1.705 |
| 3,745,876 | 7/1973 | Rocha | 89/1.816 X |
| 3,800,656 | 4/1974 | Schnäbele | 89/1.701 |
| 4,203,347 | 5/1980 | Pinson et al. | 89/1.816 |
| 4,227,438 | 10/1980 | Precoul | 89/1.816 |

FOREIGN PATENT DOCUMENTS

| | | | |
|---|---|---|---|
| 665167 | 3/1936 | Fed. Rep. of Germany | 89/14 D |
| 17032345 | 12/1971 | Fed. Rep. of Germany | 89/14 D |

*Primary Examiner*—David H. Brown

*Attorney, Agent, or Firm*—Schwartz, Jeffery, Schwaab, Mack, Blumenthal & Koch

[57] ABSTRACT

A shock suppressing device adapted to be attached to the aft end of a shoulder fired rocket launcher. The device comprises an elongated, flexible, tubular member formed of a compressible, permeable fabric. The member has an expanded diameter substantially greater than the diameter of the exhaust opening in the aft end of the rocket launcher tube. In one embodiment, the rear of the member is covered with fabric so that the member forms a bag covering the exhaust opening of the rocket launcher. The member has a sufficient expanded volume to contain the exhaust gases generated by a launched rocket thereby confining these exhaust gasses and their associated flash, smoke and blast wave. The blast wave is dissipating by forcing it to penetrate the member. In another embodiment, the rear of the member is open thus causing the generated shock wave to be accelerated rearwardly while being dissipated. The full expansion of the shock wave is not allowed until the shock wave has been reduced significantly.

22 Claims, 12 Drawing Figures

FIG. 1
(PRIOR ART)
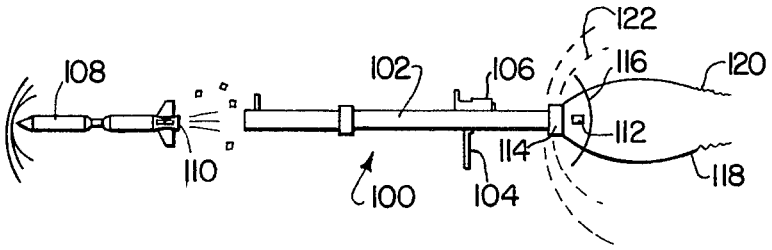
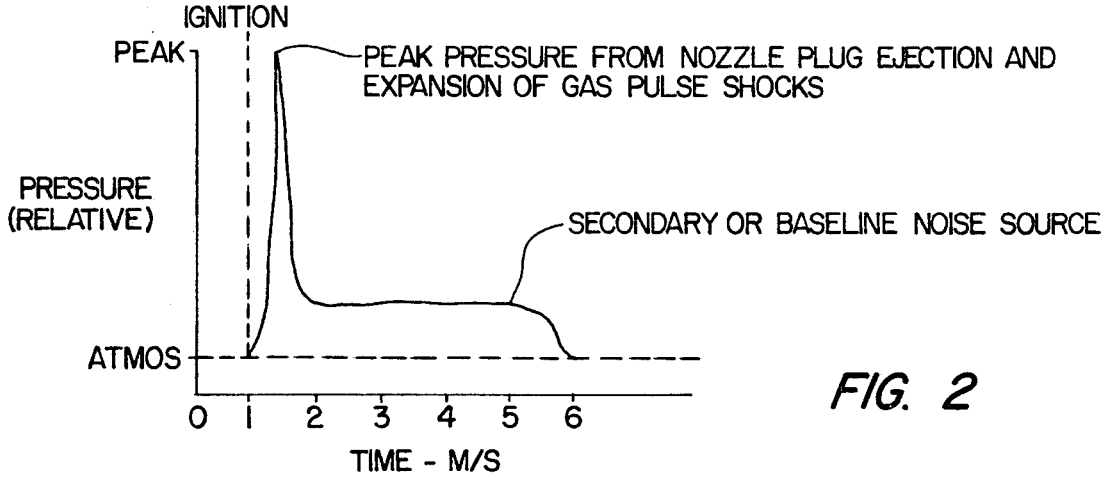
FIG. 2
FIG. 3
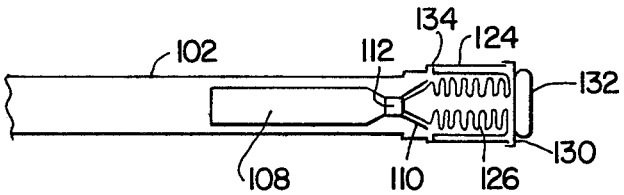
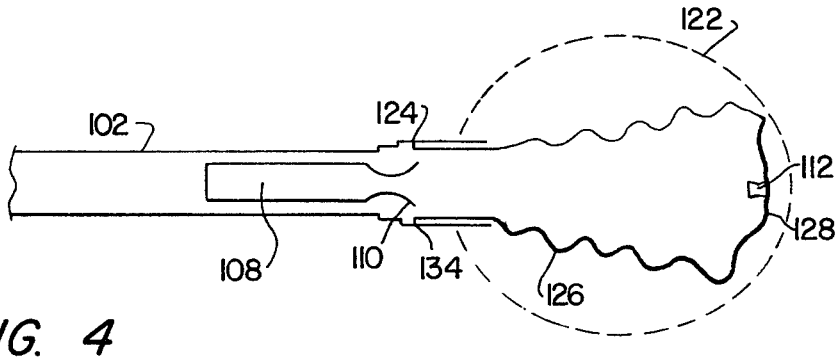
FIG. 4

NOISE, FLASH AND SMOKE SUPPRESSOR APPARATUS AND METHOD FOR ROCKET LAUNCHER

BACKGROUND OF THE INVENTION

1. Field of the Invention

The present invention relates to a shock suppressing apparatus and method for a shoulder fired rocket launcher.

2. Discussion of Related Art

A typical shoulder fired rocket launcher comprises an elongated tube which, in its firing position, is placed on the shoulder of the operator, with the forward end through which the rocket is discharged being positioned several feet forward of the operators's head, and with the rear end being a short distance rearwardly of the operator's head. The rocket itself is located in the rear end of the launch tube, and the rocket nozzle is closed by a plug. Upon ignition, there is a very rapid pressure build-up in the rocket propellant chamber, and at a predetermined design pressure level, the nozzle plug is expelled from the nozzle rearwardly at a high velocity, generally in the supersonic range. The rocket is then propelled forwardly through the tube toward its intended target, with the exhaust of the rocket being emitted outwardly from the rear end of the launch tube.

Recent developments in shoulder fired rocket propelled weapons have produced systems that release energy levels in the crew areas that create increased hearing loss hazards. The firing of one of these weapons generally creates a peak noise pulse that can exceed 180 decibels at the gunner's position. In this environment, the gunner is required to wear earplugs or earmuffs or possibly both. Even with this protection, gunners may suffer major temporary or permanent hearing loss problems that could degrade their effectiveness in performing regular duties. Also, the flash and smoke produced by one of these weapons gives away the gunner position and makes it vulnerable to return fire.

Attempts to solve the problem have been concentrated on tailoring the propulsion system to minimize peak noise levels. As discussed above, most small rocket engines have a plug in the throat of the nozzle to allow the chamber pressure to build up to a required level before firing, at which time the plug is expelled. The plug velocity after expulsion is supersonic and creates a shock wave for a short distance after it leaves the rocket nozzle. The shock wave created by the plug has been found to be a minor source of rocket engine noise. The major peak noise source is the initial pulse of rapidly expanding high pressure exhaust gasses issuing from the rocket propellant chamber, through the nozzle and into the atmosphere just after the plug is expelled. To reduce the peak noise level, considerable research has been conducted to optimize the pressure level and propellant burn time reached before the plug is expelled. Research has been successful in varying these parameters, however, it has not been successful in reducing the noise level to any significant extent. A further attempt to reduce the noise level is based on energy conservation. This technique is illustrated by the "Armbrust Weapons System." The basic technique is both to perform mechanical work and to contain the gases generated by the firing inside a pressure vessel. In this system, both the missile and an inert mass are enclosed in a pressure chamber of a launch tube, with the motor being placed between the missile and the inert mass. When the weapon is fired, the missile and the inert mass move in opposite directions to minimize recoil, and the motor exhaust products are trapped inside the pressure chamber. The gases are released over a relatively long period of time with the noise being reduced by trapping the exhaust gases and releasing them over a long period of time.

While the approach used in the Armbrust System is effective in sound reduction, it has several severe drawbacks. It is heavy since the missile and the inert mass must have the same mass and the pressure chamber must be strong enough to hold the motor exhaust products. Thus, this apparatus is approximately twice as heavy as a conventional rocket system. Also, it is expensive to fabricate.

Another attempt to reduce the noise generated by a shoulder-fired rocket is disclosed in U.S. Pat. No. 4,203,347 issued to Pinson et al. The Pinson system uses a transient shock suppressor attached to the aft end of the launcher. The suppressor comprises a circumferential housing structure having a longitudinal axis and a forward end adapted to be mounted to the rear of a launch tube so that the longitudinal axis is in general alignment with the longitudinal axis of the launch tube. The housing structure is made from metal and mounts a plurality of baffles which extend radially inward from the housing toward the longitudinal axis of the housing. The baffles define a longitudinally aligned opening which permits rearward ejection of a nozzle plug from a rocket mounted in the launch tube and permits rearward discharge of gaseous exhaust from the rocket. The Pinson et al suppressor permits expansion of the gases coming from the rocket nozzle to near atmospheric pressure through a series of expansion chambers bounded by the baffles and the housing structure. The pressure levels reached in these chambers are very high and create the requirement for a heavy structural housing and baffles. This controlled expansion reduces the energy of the sound pressure wave emitted from the system and moves the noise emitter further away from the gunner's ear position. This design reduces the noise level at the gunner's position, however, the suppressor which is inherently heavy acts as a secondary nozzle which may propel the launcher downrange. Also, the suppressor of Pinson et al has little effect on suppressing the flash and smoke produced by the rocket.

U.S. Pat. No. 3,745,876 issued to Rocha discloses a telescoping ammunition launcher comprising two or more flash and blast deflector sections which may be telescoped into a small size and may be attached to the firing tube of a firearm. No mention is made in the Rocha disclosure concerning noise suppression, and it does not appear that the Rocha device was designed to be used as a noise suppressor.

SUMMARY OF THE INVENTION

One object of the present invention is to provide a method and apparatus for suppressing rocket motor noise, flash and smoke emitted from the launch tube of a rocket launcher.

A further object of the present invention is to suppress noise, flash and smoke without adding any appreciable carry weight or volume to the launching apparatus itself.

A further object of the present invention is to provide an apparatus which can be easily attached to the launch tube of a rocket launcher and stored in a collapsed state for later deployment.

Another object of the present invention is to provide an apparatus which can be automatically deployed upon firing a rocket.

An even still further object of the present invention is to provide an apparatus which is made from an energy absorbing material so as to attentuate a shock wave produced by a fired rocket and emitted from the rear of a launch tube.

A still further object of the present invention is to provide an apparatus and method whereby a gunner firing a rocket launcher is protected from hearing loss or other physical injury by a shock wave emitted from the rear of the rocket launcher.

Another object of the present invention is to provide an apparatus for reducing noise, flash and smoke emitted by a rocket motor, which apparatus is relatively economical to manufacture, yet is effective and reliable in use.

In accordance with these and other objects, the present invention comprises an elongated, flexible, tubular member formed of a compressible, permeable fabric. The member is connected to the rear exhaust end of a rocket launching device and has an expanded diameter substantially greater than the diameter of the exhaust opening in the exhaust end of the rocket launching device.

In one embodiment, the rear of the tubular member is covered with fabric, whereby the member forms a bag enclosing the exhaust opening. The volume of the member when expanded is sufficient to contain the gases of an exhaust blast wave generated by a launched rocket. Accordingly, the blast wave is forced to pass through the permeable fabric and thus the energy of the blast wave is dissipated while both the flash and smoke are contained.

In accordance with other aspects of the present invention, a sound energy absorbent lining is connected to the member and covers the entire inner surface of the member to increase the sound absorbent qualities of the member. Furthermore, a heat protective lining may be connected to the sound energy absorbent lining in order to protect the fabric of the member from direct exposure to heat generated by the rocket firing blast. The sound energy absorbent lining may comprise expanded foam and the heat insulative lining may comprise radiant heat reflective mylar.

In accordance with other aspects of the invention, the fabric covering the rear of the member may be attached to a nozzle plug within the rocket. In this manner, when the rocket is fired, the member is automatically deployed from a collapsed position.

Another aspect of the invention comprises the use of a porus cylindrical metallic element which is attached between the exhaust opening of the rocket launcher and the covered end of the member. The metallic element serves to catch debris generated by the plug and igniter devices and prevent the debris from penetrating the fabric of the tubular member.

In another embodiment of the present invention, the tubular member is made in a generally cylindrical shape and has an open rear end. In this embodiment, the member serves to prevent the blast wave from fully expanding at the rear of the rocket launcher. The pressure created causes the blast wave to be accelerated rearwardly through the member which attentuates the blast wave. The wave is finally allowed to expand fully at the open rear end of the member which is disposed behind the position of the gunner.

BRIEF DESCRIPTION OF THE DRAWINGS

The above and other objects of the present invention will become more readily apparent as the invention is more fully described in the detailed description, reference being had to the accompanying drawings in which like reference numerals represent like parts throughout, and in which:

FIG. 1 shows a rocket launcher on which the present invention is adapted for use;

FIG. 2 shows a graph depicting the pressure felt at the gunner's position of the rocket launcher shown in FIG. 1 versus time in milliseconds after a rocket is fired;

FIG. 3 is a schematic view showing an embodiment of the suppressor of the present invention in its stored disposition;

FIG. 4 is a schematic view showing the suppressor of FIG. 3 being automatically deployed by the firing of a rocket;

DETAILED DESCRIPTION OF THE PREFERRED EMBODIMENTS

Figure 5:
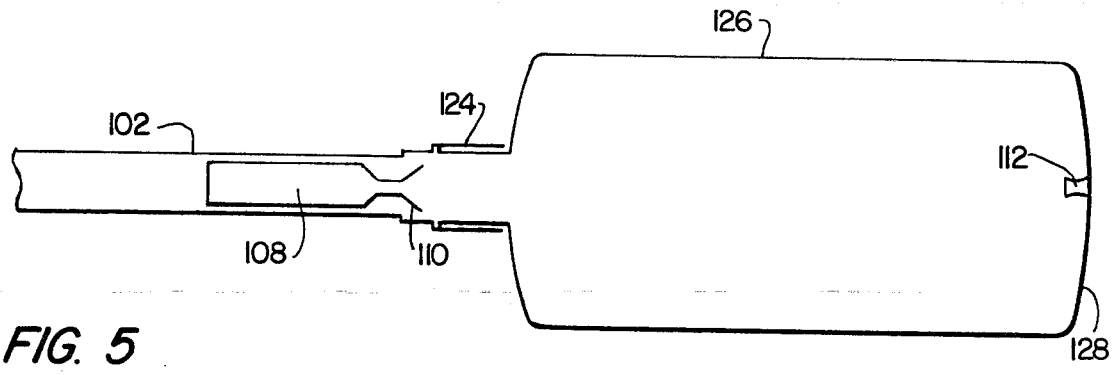
FIG. 5 is a schematic view showing the suppressor of FIG. 3 fully deployed.

A standard rocket launcher 100 is shown in FIG. 1, and can be seen to comprise an elongated launch tube 102 having one or more handles 104 and a sighting device 106. A rocket 108 is mounted in the aft end of the tube, and a nozzle 110 of the rocket is closed by a plug 112 positioned in the throat of the nozzle 110. When the propellant in the rocket is ignited, the plug causes the pressure in the combustion chamber to build up to a required level before the plug 112 is expelled. When the pressure is at the proper level, the plug is expelled from the nozzle 110 and moves a short distance outwardly through the aft end of the launch tube 102 at a very high velocity, generally in the supersonic range. The rocket 108 then proceeds out the front end of the tube 102.

The ignition of the rocket is in many respects similar to an explosion. As depicted in FIG. 2, in the first millisecond after ignition, the ejection of plug 112 is followed by a pulse of high pressure gas. This pulse, as shown in FIG. 1, is a combination of a blast wave 122 created by the exhaust shown at 118, and a shock wave 116 generated by the plug 112. Accordingly, the peak noise levels are generated within the first millisecond or so after ignition. After the initial shock or shocks, there is a quasi-steady state noise generated by the gases which continue to be discharged from the aft end of the launch tube 12, due to the shearing stresses and violent mixing that occurs between the exhaust products and the ambient atmosphere. This quasi-steady state noise is indicated in the graph of FIG. 2 as the secondary or baseline noise source.

In addition to producing noise, the gas 118 contains propellant particles that are undergoing combustion and very hot particles that emit light. These two items are the primary cause for the rocket motor flash. Aluminum oxide particles in the propellant combustion products are white in color and produce the smoke in the gas jet. The present invention consists primarily of reducing to a substantial extent the pressure pulse produced and thus the noise emitted thereby and enclosing the light generating particles thereby reducing the rocket motor flash.

FIG. 3 is a schematic drawing which depicts launch tube 102 having rocket 108 mounted therein prior to firing. Plug 112 is seen to be located within the throat of nozzle 110. A suppressor member in the form of a bag 126 has its rear portion 128 mounted to plug 112 in any convenient manner. For example, the bag 126 may be glued to plug 112. The forward end of bag 126 is mounted to a cylindrical housing 124 which is attached to the rear of launch tube 102. A cover 130 is received on the open end of housing 124. A handle 132 is conveniently attached to cover 130 for removing same from the housing. It should be understood that housing 124 may be mounted to the rear of launch tube 102 by any convenient means. For example, a spring loaded latch clip (not shown) may be used for this purpose. Also, the forward end of bag 126 is mounted to housing 124 at point 134 in a variety of ways. The bag has been glued to housing 124 with good results.

As discussed above, upon ignition, the pressure within the pressure chamber of rocket 108 builds up until plug 122 is expelled from the throat of nozzle 110. As shown in FIG. 4, since plug 112 is attached to the rear 128 of bag 126, upon being emitted from the rocket, it carries the rear of bag 126 rearwardly with it thus deploying bag 126. Also, the deployment of bag 126 causes an attentuation in the blast wave 122 as it expands past bag 126. FIG. 5 shows bag 126 completely deployed due to the expansion of gases emitted from the rocket 108.

In operation, it takes approximately four milliseconds for the bag to be completely inflated as shown in FIG. 5. Once fully deployed and inflated, the bag has a volume of approximately eight cubic feet which is sufficient to contain all of the gases emitted from rocket 108. Also, in the embodiment shown, the launch tube 102 has a diameter of approximately 2½ to 3 inches. Obviously, the volume of bag 126 would vary in accordance with the size of the rocket launcher used.

Figure 12:
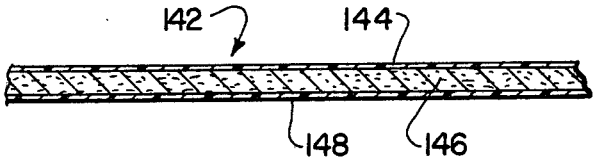
FIG. 12 is a sectional, fragmentary view showing a portion of the material from which the suppressor is made.

The material from which the bag is produced must be highly durable and also capable of absorbing sound. FIG. 12 shows a cross-section of a portion of bag 126 to indicate the layers of material used in the bag. The material is generally designated by the reference numeral 142 and comprises an outer layer 144 which is a woven or knit fabric made from a durable synthetic substance such as nylon or, more preferably, an aramid fiber such as "Kevlar." Accordingly, the fabric used in layer 144 is permeable and sufficiently flexible to be compressed and received within housing 124 where it is stored prior to use. Additionally, fabric 144 is sufficiently strong to resist the pressure wave generated by the motor of rocket 108. Under certain circumstances, bag 126 may contain only this single layer of fabric. However, for maximum effect, a layer of sound absorbent material 146 should be bonded to fabric 144. Layer 146 can be a flexible expanded foam core designed for producing a maximum sound absorbent effect. Additionally, a layer 148 of reinforced tensilized mylar is bonded to foam core 146 to protect core 146 and fabric 144 from excessive heat produced by the rocket motor. If the suppressor bag 126 is to be used on launch tube having a rocket with a long burning motor, it is highly desirable to use mylar layer 148 to shield the foam layer and fabric from heat damage. In use, the initially generated heat is shielded from the foam layer and fabric by the mylar. The pressure wave then ruptures the mylar allowing the burnt gases to penetrate the porous foam core and permeable fabric.

Figure 6:
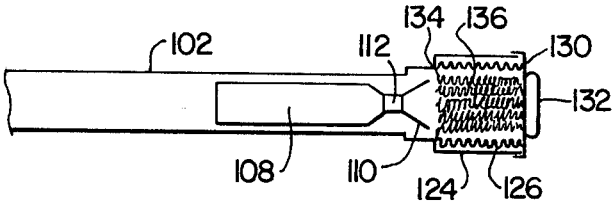
FIG. 6 is a schematic view showing a second embodiment of the suppressor of the present invention in its stored disposition.
Figure 7:
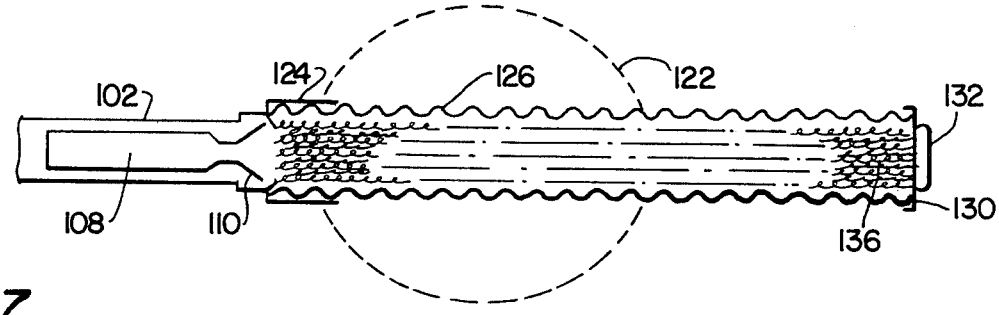
FIG. 7 is a schematic view showing the suppressor of FIG. 6 after being manually deployed and just after the rocket has been fired.
Figure 8:
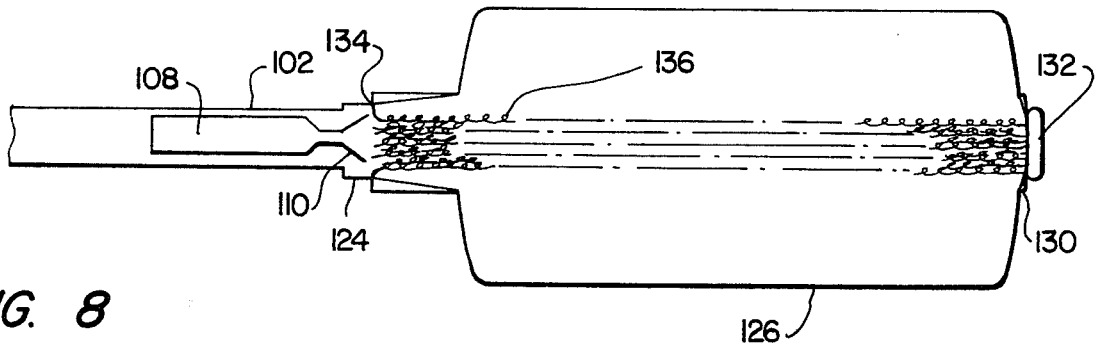
FIG. 8 is a schematic view showing the suppressor of FIG. 6 in its fully deployed disposition.

The embodiment of the invention shown in FIGS. 3–5 is quite effective for use with a plug 112 made from an expanded foam material, such as styrofoam. In actuality, the plug tends to disintegrate into many small pieces and use of a plug made from more dense material poses a danger of having the pieces penetrate bag 126. In order to overcome the danger of having other plugs penetrate bag 126, a flexible, cylindrical wire element 136 can be mounted within bag 126 as shown in FIGS. 6–8. It will be seen that element 136 is connected between attachment point 134 and cover 130. Element 136 is opened directly in the path of plug 112 for receiving the plug and confining the debris produced thereby. Element 136 is preferably made from knitted aluminum wire which can easily be compressed to fit within housing 124.

In use, inasmuch as full deployment of bag 126 is expected within four milliseconds of initiation of operation of the rocket motor, in order to avoid structural damage to element 136, it is necessary to manually initiate deployment of the present invention. As shown in FIG. 7, the gunner grasps handle 32 and pulls bag 126 and element 36 from housing 124 until they reach approximately 90 percent of their full extension. When the motor of rocket 108 is fired, the plug 112 is projected into the center of cylindrical element 136 where the debris produced by the plug is caught in the knitted wire fabric of element 136. Element 136 also absorbs a small portion of the energy in the blast wave produced. The blast wave, shown at 122 in FIG. 7, is attentuated by the relaxed material of bag 126 and causes full extension and deployment of element 136 and the bag and fully inflates the bag.

In each of the above described embodiments, it can be seen that bag 126 is added to the launcher to contain all the gas produced by the rocket motor. The bag is installed so that all noise producing elements can be trapped inside the bag. Since the exhaust gases are contained within the bag, any flash or smoke produced is obscured by the bag. The bag operation begins in a fully collapsed or partially collapsed condition so that the entire volume is available to contain the motor exhaust gases. When the plug 112 is ejected from the motor, the ensuing blast wave must penetrate the bag before it reaches the gunner's position. The walls of the bag are made from material which absorbs the blast wave energy as it penetrates the wall of the bag. The bag is partially collapsed when the blast wave penetrates the wall. This presents the blast wave more wall surface area to penetrate thereby removing more blast wave energy. The inflated bag separates the gas jet from the atmosphere, therefore, no eddies are generated between the gas jet and the atmosphere. By producing bag 126 from material 142 described above, an effective noise reduction of more than 10 decibels can be achieved.

Figure 9:
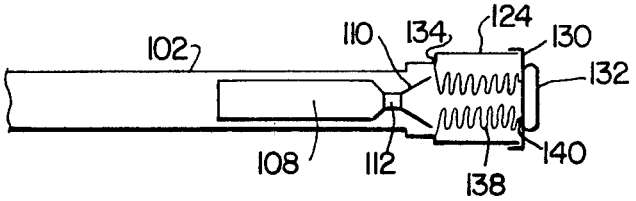
FIG. 9 is a schematic view showing a third embodiment of the present invention in its stored disposition.
Figure 10:
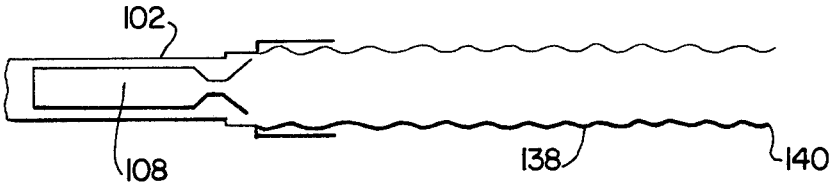
FIG. 10 shows the suppressor of FIG. 9 after having been manually deployed and just after the rocket has been fired.
Figure 11:
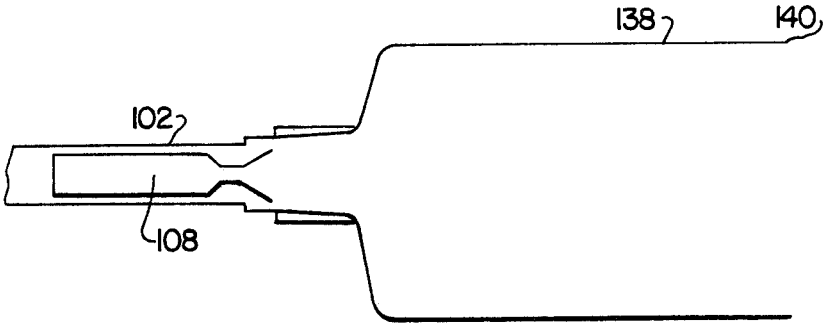
FIG. 11 is a schematic view showing the suppressor of FIG. 9 in its fully deployed disposition.

FIGS. 9, 10 and 11 show a third embodiment of the present invention in which the suppressor member 138 is similar to bag 126 except that member 138 has an open rear 140. As shown in FIG. 9, when in the stored position, member 138 is attached at 134 to housing 124. The open rear 140 is attached to cover 130. When readied for use, member 138 is partially extended by the gunner by grasping handle 132 and pulling member 138 from the housing as shown generally in FIG. 10. When rocket 108 is fired, the blast wave and exhaust gas fully extend member 138 as shown in FIG. 11. Since member 138 is designed to only partially contain the exhaust gas, it will require a smaller extended and compressed volume than bag 126 and can thereby be made lighter in weight. It has been found that with a launch tube 102 having a diameter of $2\frac{1}{2}$ to 3 inches, member 138 can be made cylindrical in shape with a diameter of six to eight inches and an overall length of 24 inches and member 138 will produce acceptable results.

The material of member 138 can be exactly the same as that of bag 126 and is shown at 142 in FIG. 12. As explained above, fabric layer 144 may be used alone if conditions warrant or can be used in conjunction with sound absorbent layer 146 and heat shielding layer 148. The three-layer configuration is preferred for maximum effect.

In operation, when rocket 108 is fired as shown in FIG. 10, the relaxed condition of member 138 presents a maximum surface area to the blast wave generated. This causes a weakening of the blast wave which must expend energy inflating member 138 and penetrating the material thereof. Member 138 also has the effect of confining the blast wave thereby causing the wave to accelerate rearwardly toward the open rear 140 thus preventing the wave from expanding near the gunner. As the wave is accelerated rearwardly, the energy of the wave is attentuated so that when the wave finally expands past the rear opening 140, the energy released has significantly diminished. Member 138 retains much of the noise suppressing capability of bag 126 by partially containing the exhaust gases and also retains some of the capabilities for obscuring the flash and smoke.

The above description is considered illustrative of the invention but not limitative. Clearly, numerous modifications, additions or changes can be made in the present invention without departing from the scope thereof, as set forth in the appended claims.

What is claimed is:

1. In combination with a rocket launching device, said rocket launching device comprising an elongated launch tube, said launch tube having a forward end from which a rocket is fired, and a rear exhaust end through which exhaust gases exit during firing of the rocket, said exhaust end having an exhaust opening of a predetermined diameter, a shock suppressing apparatus comprising:

an elongated, flexible, tubular member formed of a compressible, permeable mesh fabric formed of fibers, said fabric being sufficiently strong to resist a pressure wave generated by firing said rocket and said member having an expanded diameter substantially greater than the diameter of said exhaust opening; and further including a forward end for attachment to said exhaust opening and a rear end extending away from said forward end; and means for attaching said forward end of said tubular member to said rear exhaust end of said launch tube such that said tubular member remains connected to said launch tube during firing of said rocket.

2. The invention as set forth in claim 1, wherein said fabric is made of an aramid fiber.

3. The invention as set forth in claim 1 wherein said tubular member has an open rear for accelerating a shock wave rearwardly to a position behind a gunner operating said launcher.

4. The invention as set forth in claim 1, wherein said rear end of said member is covered with said fabric whereby said tubular member forms a bag enclosing said exhaust opening, said tubular member receiving the gases of an exhaust blast wave generated by a launched rocket thereby forcing said blast wave to pass through said permeable fabric and dissipating energy of said blast wave; and means for holding said bag in alignment with said rocket launching device prior to firing of said rocket, whereby gases of an exhaust blast can pass directly into said tubular member.

5. The invention as set forth in claim 4 and further wherein a rocket to be fired is contained in said launch tube, said rocket having a nozzle containing a nozzle plug, said fabric covering said rear of said tubular member being attached to said plug whereby said member is deployed from a collapsed position upon firing said rocket.

6. The invention as set forth in claim 4 and further including a cylindrical metallic element extending from said exhaust opening to said covered end of said member.

7. The invention as set forth in claim 6, wherein said element is made from aluminum wire.

8. The invention as set forth in claim 1 or 4 and further including a sound energy absorbent lining connected to said fabric.

9. The invention as set forth in claim 8, wherein said sound energy absorbent lining comprises expanded foam.

10. The invention as set forth in claim 8 and further including a heat insulative lining connected to said sound energy absorbent lining.

11. The invention as set forth in claim 10, wherein said heat insulative lining comprises radiant heat reflective mylar.

12. A method of suppressing a shock wave generated by a rocket launching device, wherein the rocket launching device comprises an elongated launch tube, a forward end from which a rocket is fired, and a rear exhaust end through which exhaust gases exit during firing of the rocket, said exhaust end having an exhaust opening with a predetermined cross-sectional area, said method comprising:

providing an elongated, flexible, tubular member formed of a compressible, permeable mesh fabric formed of fibers and having an expanded diameter substantially greater than the diameter of said exhaust opening;

attaching said tubular member over the rear exhaust opening in an uninflated condition; and suppressing a shock wave generated by firing the rocket in the launch tube by causing said shock wave to inflate said member thereby partially absorbing the shock wave in the fabric of said member without destroying said fabric material and without said tubular member becoming detached from said launching device.

13. The method as set forth in claim 12 and further comprising providing an open rear end on said member for accelerating said shock wave rearwardly in said member to a position behind a gunner.

14. The method as set forth in claim 12 including providing a fabric covering over the rear of said member to form a bag surrounding said exhaust opening thereby containing said shock wave and causing said shock wave to penetrate the fabric of said member, and holding said bag in alignment with said rocket launching device prior to firing said rocket.

15. The method as set forth in claim 12 or 14 and further comprising providing a sound absorbent lining connected to said fabric.

16. The method as set forth in claim 14 and further comprising connecting the covering over the rear of said member to a plug contained in the nozzle of a rocket within said rocket launching device and automatically deploying said member upon firing of said rocket.

17. The method as set forth in claim 14 and further comprising providing a cylindrical metallic element aligned with the rear of said exhaust opening.

18. In combination with a rocket launching device, said rocket launching device comprising an elongated launch tube, said launch tube having a forward end from which a rocket is fired, and a rear exhaust end through which exhaust gases exit during firing of the rocket, said exhaust end having an exhaust opening of a predetermined diameter, a shock suppressing apparatus comprising:

an elongated, flexible, tubular member formed of a compressible, permeable fabric, said fabric having an expanded diameter substantially greater than the diameter of said exhaust opening; and said elongated, flexible, tubular member further including a forward end for attachment to said exhaust opening, and a rear end extending away from said forward end;

means for attaching said forward end of said tubular member to said rear exhaust end of said launch tube;

wherein said rear end of said member is covered with said fabric whereby said tubular member forms a bag enclosing said exhaust opening, and said tubular member has a sufficient expanded volume to contain the gases of an exhaust blast wave generated by a launched rocket thereby forcing said blast wave to pass through said permeable fabric and a dissipating energy of said blast wave, and further wherein a rocket to be fired is contained in said launch tube, said rocket having a nozzle containing a nozzle plug, said fabric covering said rear of said tubular member being attached to said plug whereby said member is deployed from a collapsed position upon firing said rocket.

19. In combination with a rocket launching device, said rocket launching device comprising an elongated launch tube, said launch tube having a forward end from which a rocket is fired, and a rear exhaust end through which exhaust gases exit during firing of the rocket, said exhaust end having an exhaust opening of a predetermined diameter, a shock suppressing apparatus comprising:

an elongated, flexible, tubular member formed of a compressible, permeable fabric said fabric having an expanded diameter substantially greater than the diameter of said exhaust opening; and said elongated, flexible, tubular member further including a forward end for attachment to said exhaust opening, and a rear end extending away from said forward end;

means for attaching said forward end of said tubular member to said rear exhaust end of said launch tube;

wherein said rear end of said member is covered with said fabric whereby said tubular member forms a bag enclosing said exhaust opening, and said tubular member has a sufficient expanded volume to contain the gases of an exhaust blast wave generated by a launched rocket thereby forcing said blast wave to pass through said permeable fabric and a dissipating energy of said blast wave, and further including a cylindrical metallic element extending from said exhaust opening to said covered end of said member.

20. The invention as set forth in claim 19 wherein said element is made from aluminum wire.

21. A method of suppressing a shock wave generated by a rocket launching device, wherein the rocket launching device comprises an elongated launch tube, a forward end from which a rocket is fired, and a rear exhaust end through which exhaust gases exist during firing of the rocket, said exhaust end having an exhaust opening with a predeterminted cross sectional area; said method comprising providing an elongated, flexible, tubular member having an enclosed rear to form a bag, said member being formed of a compressible, permeable fabric and having an expanded diameter substantially greater than the diameter of said exhaust opening;

attaching said tubular member over the rear exhaust opening in an uninflated condition such that said bag surrounds said exhaust opening, and connecting the enclosed rear of said member to a plug contained in the nozzle of a rocket within said rocket launching device;

automatically deploying said member upon firing said rocket; and suppressing a shock wave generated by firing the rocket in the launch tube by causing said shock wave to inflate said member thereby partially absorbing the shock wave in the fabric of said member and causing said shock wave to penetrate the fabric of said member.

22. A method of suppressing a shock wave generated by a rocket launching device, wherein the rocket launching device comprises an elongated launch tube, a forward end from which a rocket is fired, and a rear exhaust end through which exhaust gases exit during firing of the rocket, said exhaust end having an exhaust opening with a predetermined cross sectional area; said method comprising providing an elongated, flexible, tubular member having an enclosed rear and containing a cylindrical metallic element, said tubular member being formed of a compressible permeable fabric and having an expanded diameter substantially greater than the diameter of said exhaust opening;

attaching said tubular member over the rear exhaust opening in an uninflated condition such that said cylindrical metallic element is aligned with the rear of said exhaust opening; and suppressing a shock wave generated by firing the rocket in a launch tube by causing said shock wave to inflate said member thereby partially absorbing the shock wave in the fabric of said member and causing said shock wave to penetrate the fabric of said member.

* * * * *